US005109677A

United States Patent [19]

Phillippe

[11] Patent Number: 5,109,677

[45] Date of Patent: May 5, 1992

[54] SUPPLEMENTAL HEAT EXCHANGER SYSTEM FOR HEAT PUMP

[76] Inventor: Gary Phillippe, 7263 Larchmont Dr., North Highlands, Calif. 95660

[21] Appl. No.: 660,141

[22] Filed: Feb. 21, 1991

[51] Int. Cl.[5] ..... F25B 13/00

[52] U.S. Cl. ..... 62/160; 62/199; 237/2 B

[58] Field of Search ..... 62/160, 199, 238.7, 62/208; 237/2 B

[56] References Cited

U.S. PATENT DOCUMENTS

| | | | |
|---|---|---|---|
| 3,024,619 | 3/1962 | Gerteis et al. | 62/160 |
| 3,365,902 | 1/1968 | Nussbaum | 62/155 |
| 3,537,274 | 11/1970 | Tilney | 62/224 |
| 3,918,268 | 11/1975 | Nussbaum | 62/150 |
| 4,171,622 | 10/1979 | Yamaguchi et al. | 62/160 |
| 4,173,865 | 11/1979 | Sawyer | 62/324 |
| 4,266,405 | 5/1981 | Trask | 62/160 |
| 4,449,377 | 5/1984 | Draper | 62/324.1 |
| 4,553,401 | 11/1985 | Fisher | 62/160 |
| 4,563,879 | 1/1986 | Hama et al. | 62/160 |
| 4,761,964 | 8/1988 | Pacheco | 62/160 |

FOREIGN PATENT DOCUMENTS 53-38143 4/1978 Japan .

*Primary Examiner*—William E. Wayner
*Attorney, Agent, or Firm*—James M. Ritchey

[57] ABSTRACT

For use with a heat pump to increase cold weather heating efficiency, a supplemental heat exchanger and associated refrigerant flow lines for generating additional expanded refrigerant and transferring the additional expanded refrigerant to the heat pump compressor during the cold outside conditions, included isn a monitoring system for detecting and actively regulating the refrigerant pressure and temperature at a location in the supplemental heat exchanger and associated refrigerant flow lines just prior to the refrigerant entering the compressor. The monitoring system automatically connects the supplemental heat pump, to enhance the heating cycle capabilities, and disconnects the supplemental heat pump, when the enhanced heating cycle capabilities are no longer required.

14 Claims, 4 Drawing Sheets

SUPPLEMENTAL HEAT EXCHANGER SYSTEM FOR HEAT PUMP

BACKGROUND OF THE INVENTION

1. Field of the Invention

This invention relates to a modified and improved heat pump or a retrofit alteration to an existing heat pump that enables the heat pump to increase its heating efficiency of an indoor space during cold outdoor conditions. A supplemental coil or heat exchanger system is provided that includes a control means for actively regulating within an efficient operating range the refrigerant suction pressure and temperature. As a direct result of the supplemental heat exchanger and the control means, additional heat may be drawn from outside air surrounding the main heat exchanger and supplemental heat exchanger units, thereby decreasing the need for expensive auxiliary resistance type heating strips.

2. Description of the Background Art

Devices relying upon standard heat pump technologies have been available for many years. Within the limits of each associated design specification, these devices enable a user to cool or heat a selected environment. For these heating and cooling duties, in general, gases or liquids are compressed, expanded, heated, or cooled within an essentially closed system to produce a desired temperature result in the selected environment. To accomplish the heating and cooling, heat is transferred from one location to another.

On days or evenings when the outside temperature nears or drops below freezing the efficiency of traditional heat pump systems drops off significantly. The subject apparatus and method of use overcomes this difficulty by enhancing, at low outside temperatures, the amount of expanded refrigerant that returns to the heat pump compressor, thereby increasing the efficiency of the heat exchange process by supplying additional heat containing refrigerant.

Concerning the existing prior references, specifically, U.S. Pat. No. 3,024,619 relates a heat pump system having an additional row of finned tubes on the outdoor heat exchanger. Due to a first associated check valve, the additional finned tubes act as a sub-cooler during a cooling cycle. When the system is run in reverse direction for heating, a second check valve passes coolant through the auxiliary coil thereby increasing heating capacity during the heating cycle without adversely affecting cooling operation. No direct monitoring coolant temperatures or pressures are associated with the regulation of this process.

A reverse cycle refrigeration system is disclosed in U.S. Pat. No. 3,365,902. The apparatus acts as a heat pump or as a system having a normal refrigeration phase and a hot gas defrost phase. A set of heat source coils forming a distinct refrigerant circuit is separate from the condenser coils but contained in a common fin bundle with the condenser coils.

U.S. Pat. No. 3,537,274 provides a dual evaporator refrigeration system. The system permits alternate connection of the evaporators for cooling while using the liquid refrigerant as the source of heat for defrosting the disconnected evaporator. There are two separate evaporators and a four-way valve for alternately connecting one or the other evaporator to the outlet side of the expansion device. The other evaporator is connected in the liquid refrigerant flow line so that liquid refrigerant passes through it. This liquid refrigerant serves as the source of heat for defrosting the evaporator not being used. As the four-way valve switches, the actions of the evaporators switch.

Disclosed in U.S. Pat. No. 3,918,268 is a heat pump with a frost-free outdoor coil. A heating means is associated with the normal outside coil to prevent the surface temperature of the outside coil from falling below 32° C. Means are provided to prevent liquid floodback into the compressor when a changeover occurs from heating to cooling.

Described in U.S. Pat. No. 4,171,622 is a heat pump including an auxiliary outdoor heat exchanger acting as a defroster and sub-cooler. Located underneath the main outdoor heat exchanger and connected between the indoor and main outdoor heat exchangers is the auxiliary exchanger. During cooling the auxiliary exchanger acts as a sub-cooler and during heating it functions as a defroster for melting a block of ice that may have accumulated under or within the main outdoor heat exchanger.

U.S. Pat. No. 4,173,865 relates an auxiliary coil arrangement for a heat pump. The auxiliary coil is connected in parallel refrigerant flow arrangement with the expansion device of the heat pump. Standard check valves are provided to permit the auxiliary coil to function as a sub-cooler when the associated heat exchanger functions as a condenser.

Presented in U.S. Pat. No. 4,266,405 is a heat pump refrigerant circuit to reduce the time length of defrost cycles in contemporary air-to-air heat pumps. This reduction is accomplished by having two parallel refrigerant circuits connect the reversing valve to an outdoor coil. To regulate the direction of refrigerant flow, standard check valves are included.

A thermosyphon coil arrangement for a the outside unit of a heat pump is described in U.S. Pat. No. 4,449,377. When the heat pump is operating in the heating mode, the refrigerant flow is controlled by thermosyphoning action. Further, the coil placement and refrigerant flow are arranged for an outdoor unit so that the coil operates in an optimal thermosyphon fashion in the heating mode.

U.S. Pat. No. 4,553,401 discloses a reversible cycle heating and cooling system. Introduced is an auxiliary outdoor heat exchanger that is coupled with a water source for enhancing the capacity and efficiency of the system to transfer heat to the refrigerant during the heating mode at low outdoor ambient temperatures.

A capillary tube-type expansion device for a heat pump is explained in U.S. Pat. No. 4,563,879. To regulate the device, a control unit detects the temperature of the outside air and the discharge water temperature of a water-cooled heat exchanger and applies a suitable control signal to an electrical expansion valve.

An apparatus for enhancing the performance of a heat pump is given in U.S. Pat. No. 4,761,964. First and second auxiliary coils are heated with associated radiant quartz heating elements. Outdoor temperature is employed, via a pair of thermostats, to regulate the operation of the quartz heaters.

Provided in Japanese Patent No. 38,143 is a heat pump type system having first and second units. The amount of cooling medium is regulated to provide maximum heating and cooling capacity.

SUMMARY OF THE INVENTION

An object of the present invention is to produce device and method of use that increases the efficiency of a heat pump during cold outside conditions.

Another object of the present invention is to relate a supplemental heat exchanger, refrigerant flow lines, and monitoring system that automatically enhances the ability of a heat pump to generate comfortable levels of indoor heat during cold outdoor weather without the need for resistance type heating strips.

A further object of the present invention is to disclose a supplemental heat exchanger, associated refrigerant flow lines, and control means that are incorporated directly into newly manufactured heat pumps or retrofitted into existing heat pumps.

An additional object of the present invention is to make a supplemental heat exchanger, associated refrigerant flow lines, and control means that is connected to an existing heat pump with a minimum of modifications to the existing flow lines.

Disclosed is a supplemental coil or heat exchanger and associated refrigerant flow lines incorporated into a refrigerant recirculating heat pump and actively controlled by a monitor that detects refrigerant pressure and temperature after the supplemental heat exchanger. Means are provided for generating additional expanded refrigerant within the supplemental heat exchanger and transferring the additional expanded refrigerant to the compressor of the heat pump. Additionally, the monitor detects the refrigerant pressure and temperature at a location in the system just prior to the refrigerant entering the compressor. The monitor automatically connects the supplemental heat exchanger and associated refrigerant flow lines to the traditional heat pump components, to enhance the heating cycle capabilities, and disconnects, when the enhanced heating cycle capabilities are no longer required.

Other objects, advantages, and novel features of the present invention will become apparent from the detailed description that follows, when considered in conjunction with the associated drawings.

DESCRIPTION OF THE PREFERRED EMBODIMENT

Figure 1:
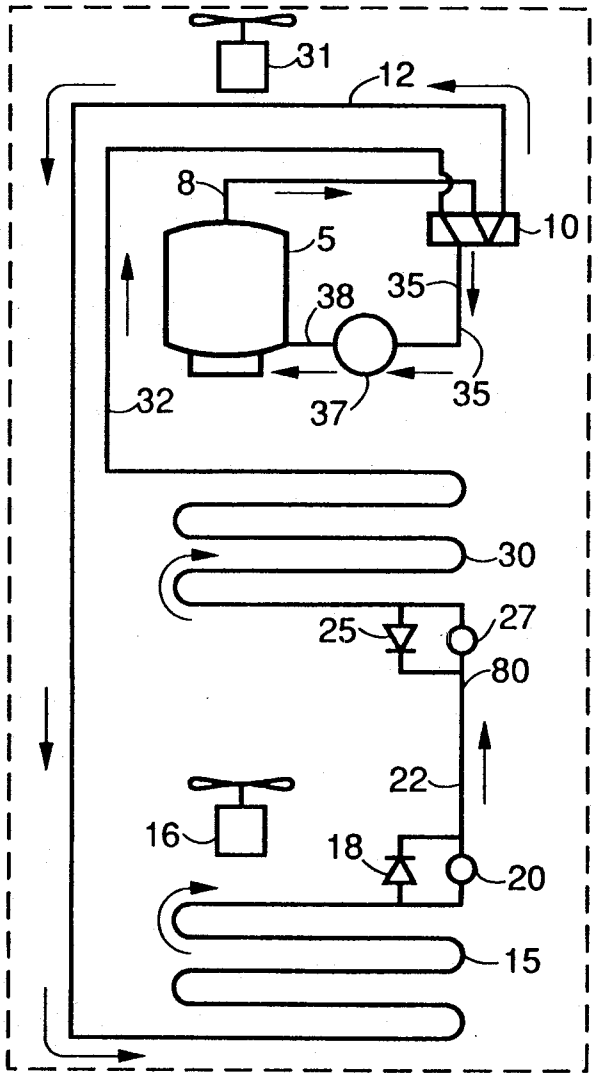
FIG. 1 is a schematic diagram showing the flow of refrigerant during a typical heating cycle for a generalized heat pump system.
Figure 2:
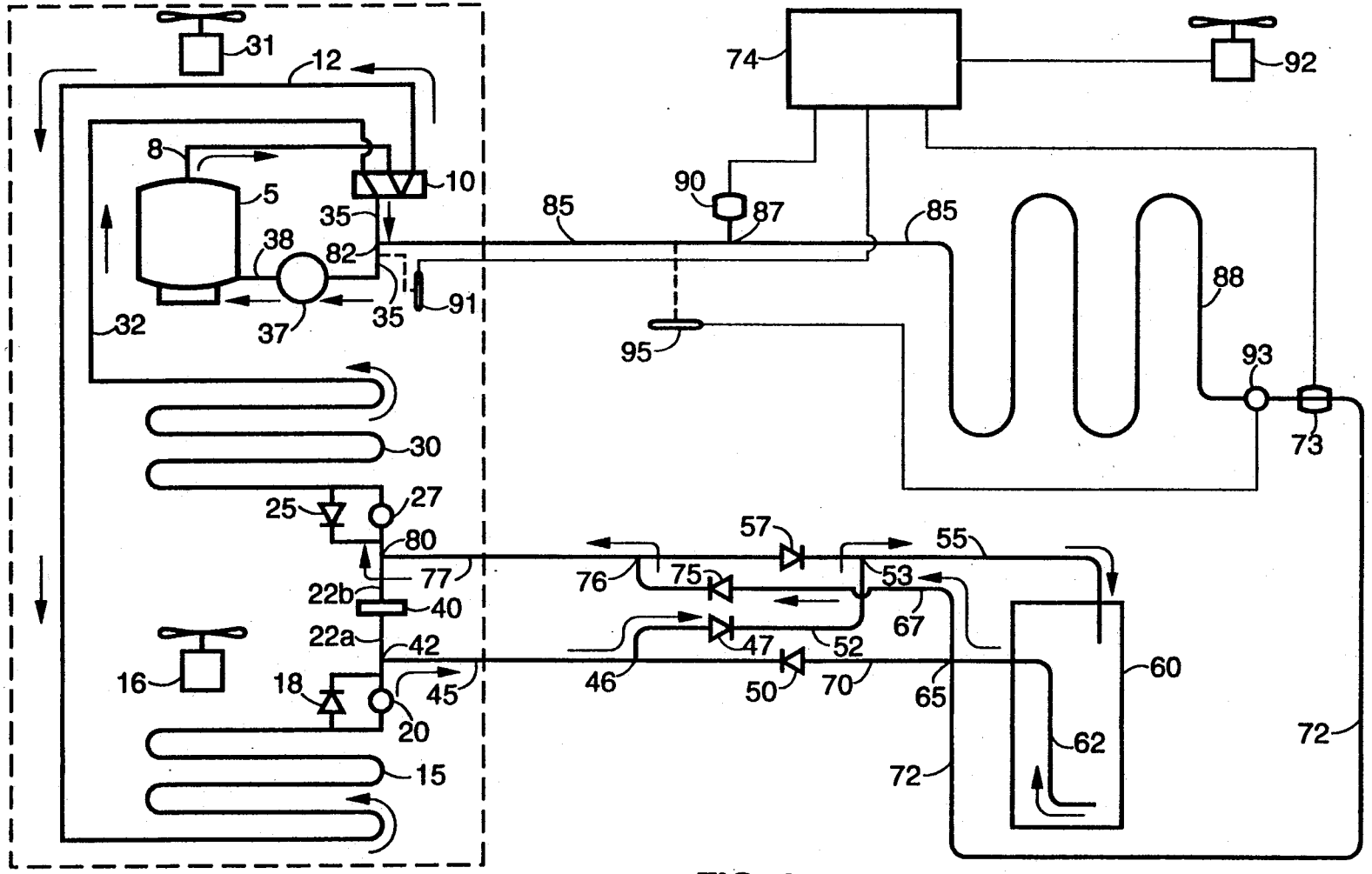
FIG. 2 is a schematic diagram showing the subject apparatus attached to the generalized heat pump system of FIG. 1, including the flow of refrigerant for nonassisted operation of the heat pump during a heating cycle.
Figure 3:
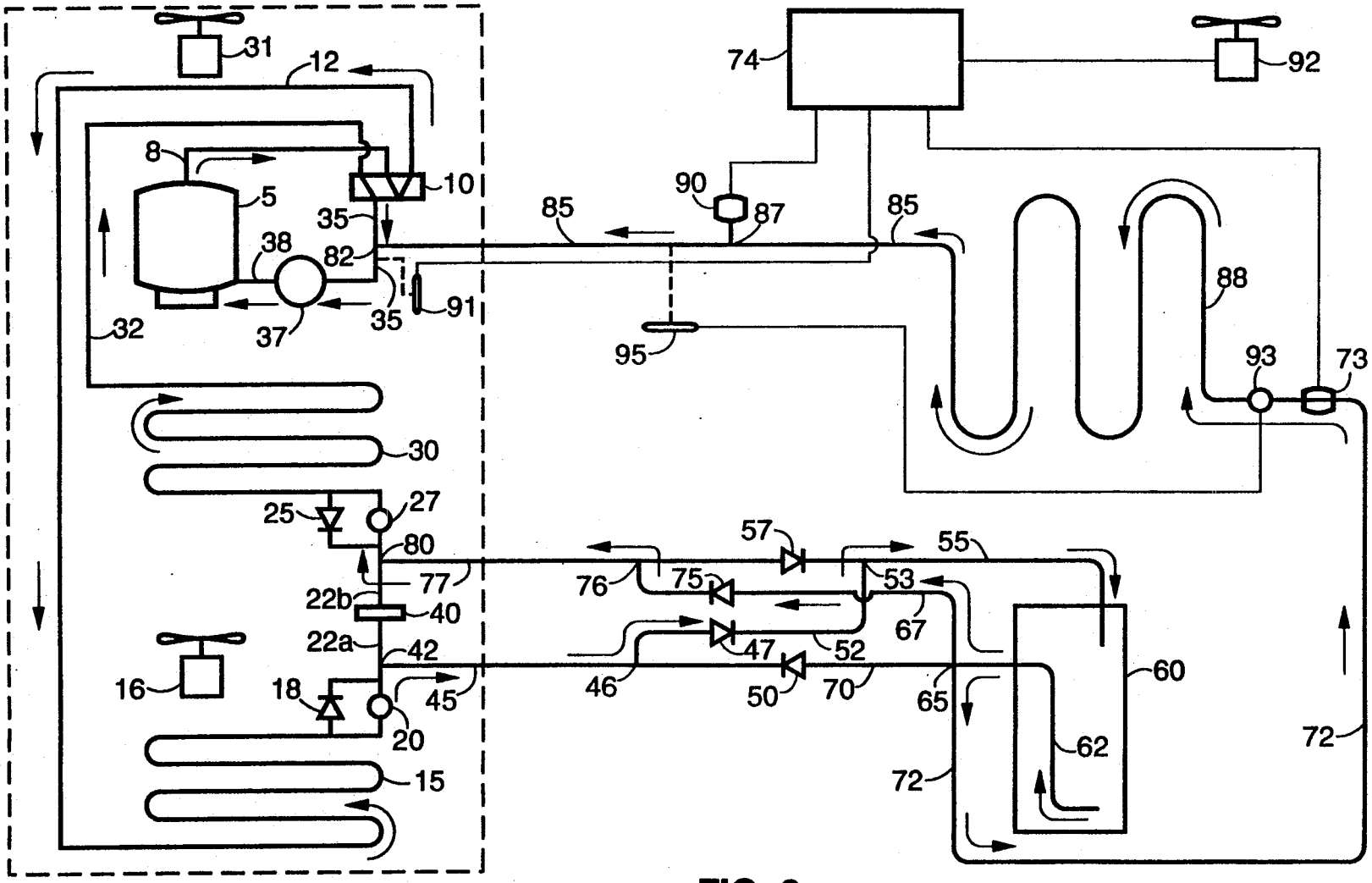
FIG. 3 is a schematic diagram showing the subject apparatus attached to the generalized heat pump system of FIG. 1, including the flow of refrigerant during a subject apparatus assisted heating cycle.
Figure 4:
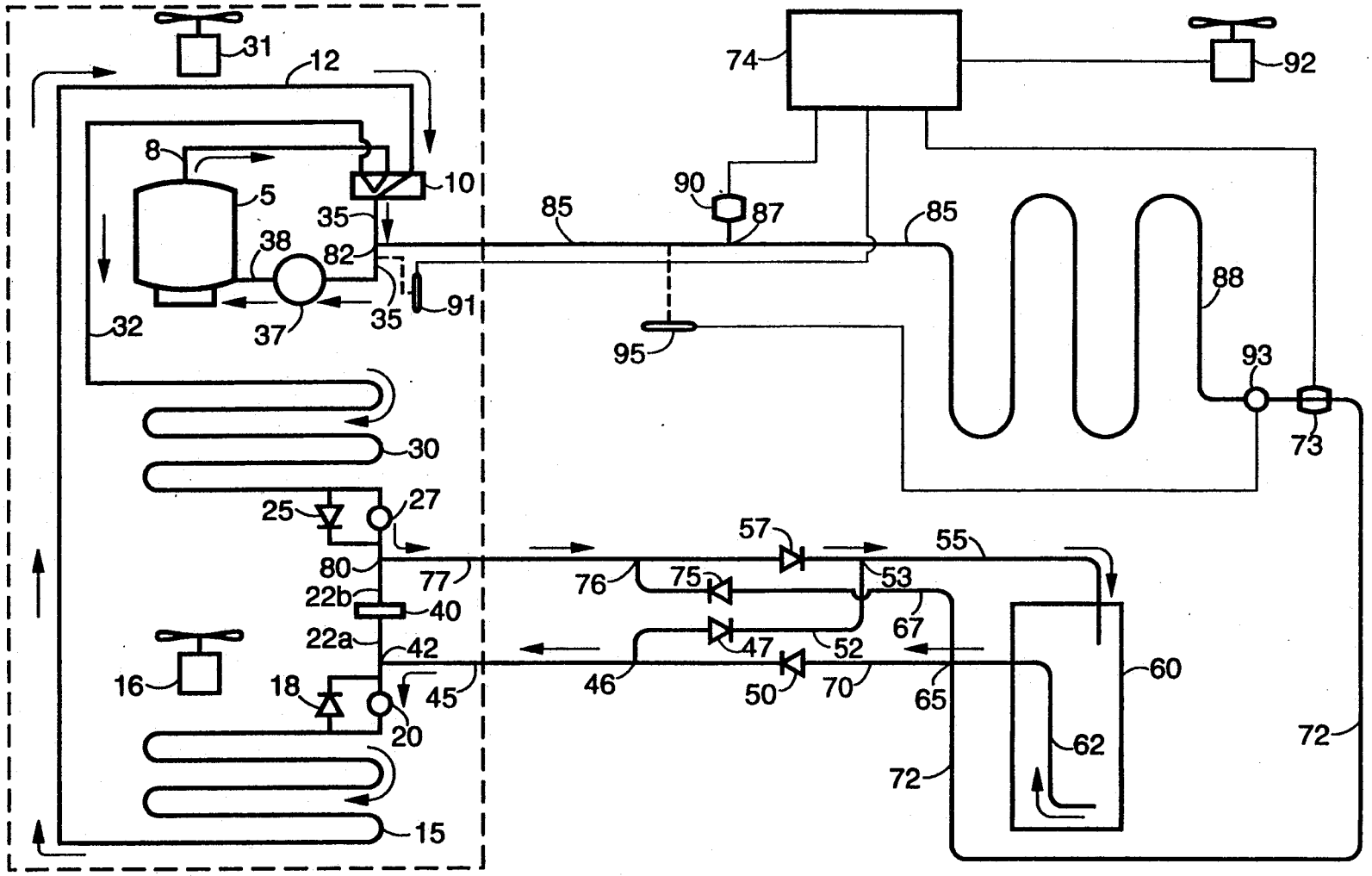
FIG. 4 is a schematic diagram showing the subject apparatus attached to the generalized heat pump system of FIG. 1, including the flow of refrigerant during a cooling cycle.

Referring now to FIG. 1 for a generalized heat pump and to FIGS. 2–4 for a preferred embodiment of a supplemental coil or heat exchanger system for such a heat pump. To quickly appreciate the benefits of the subject device, a brief description of the functioning of a heat pump is presented (see, FIG. 1). An expandable-compressible refrigerant is contained and cycled within an essentially enclosed system comprised of various refrigerant manipulating components. When a liquid refrigerant expands to produce a gas it increases its heat content at the expense of a first surrounding environment which decreases in temperature. The heat rich refrigerant is transported to a second surrounding environment and the heat content of the expanded refrigerant released to the second surroundings via condensation, thereby increasing the temperature of the second surrounding environment. Heating or cooling conditions are generated in the first and second environments by reversing the process within the enclosed system. Customarily, when a heat pump is utilized to regulate the temperature within a building, the first environment is within the structure and the second environment is outside the structure (a building is described as an example only and other environments such as those used with standard refrigeration units are considered to be within the realm of this disclosure). To heat the interior of a building, expanded, heat rich refrigerant is produced within the enclosed system at the expense of second or outside environment's energy. Should the exterior temperature fall to freezing or below, the efficiency of expanding the refrigerant decreases and thus the heat transferred to the building drops. During near of below freezing outdoor conditions most traditional heat pump systems employ additional heating units such as resistance heating strips. Such heating strips are costly to operate.

As, indicated, FIG. 1 depicts a typical heat pump system, but it must be stressed that the subject invention is suitable for modifying any equivalent heat pumps systems. Regardless of whether of not the heat pump is functioning as a cooling or heating unit, a compressor 5 dispenses high pressure gaseous refrigerant through flow line 8 into a four-way switchable valve 10. The four-way valve 10 serves as a means for reversing the direction of refrigerant flow during a heating or cooling cycle.

Specifically, for a heating cycle in a standard heat pump, the high pressure expanded or gaseous refrigerant exits the four-way valve 10, passes through a flow line 12 and into an indoor condenser 15 (when the unit is used in a heating cycle, the term condenser is often used, but generally the unit is an indoor or first environment heat exchanger). The high pressure gaseous refrigerant condenses into a liquid, thereby releasing much of its heat content to warm the surrounding air. A blower or fan 16 aids in distributing the released warmed air within the building.

The liquid refrigerant travels from the indoor condenser 15, usually regulated to unidirectional flow by a check valve 18 and to controlled expansion by expansion valve 20, into a flow line 22 and generally past a check valve 25 and an expansion valve 27 into an outdoor evaporator 30 (when the unit is used in a heating cycle, the term evaporator is often used, but generally the unit is an outdoor or second environment heat exchanger). Within the outdoor evaporator 30 heat is taken on by the refrigerant (aided by a blower or fan 31 to circulate the air), which gasifies and returns via flow line 32 to the four-way valve 10. Exiting the four-way valve 10, the expanded refrigerant moves by suction through flow line 35, usually passing through a standard accumulator 37, and into the compressor 5, by way of a final flow line 38. The returning refrigerant, via line 38, is at a lower pressure than the compressor exiting refrigerant, at line 8.

For a cooling cycle in a standard heat pump, the high pressure gaseous or expanded refrigerant is produced by the compressor 5 and fed into the flow line 8, as with the heating process above. However, for cooling the inside of a building (first environment) the four-way valve 10 is positioned to direct the flow of the high pressure refrigerant into line 32, thereby reversing the refrigerant flow direction through the indoor 15 and outdoor 30 heat exchangers.

As indicated above for an indoor heating cycle, it is well known that during near freezing or sub-freezing outside conditions the heat absorbed by the refrigerant in the expansion process, in the outside evaporator 30, is limited. The subject device increases the ability of the refrigerant to gain heat from the outdoor conditions by adding additional refrigerant expansion capabilities to the system.

FIGS. 2–4 indicate the subject invention coupled into an existing heat pump and operating in various possible modes such as standard heating without assistance or passive coupling from the subject device (see FIG. 2), heating with assistance or active coupling from the subject device (see FIG. 3), and cooling or passive coupling from the subject device (see FIG. 4). FIG. 2 illustrates a preferred manner in which the subject device is coupled into an existing heat pump with one set of connections between the indoor and outdoor heat exchangers and another connection immediately before the compressor's refrigerant return port. Even though the preferred method of use for the subject device is in the modification of a pre-existing heat pump, it must be stressed that the subject device applies equally well to the production of new heat pumps that incorporate the subject invention in their original design.

Specifically, FIG. 2 shows that a clamp or block 42 has been introduced into the flow line 22 that connects the indoor 15 and outdoor 30 heat exchangers. The block 42 completely prevents the refrigerant from directly passing the point at which the block 42 is attached. Any suitable method of blocking the line is contemplated, including a clamp, valve, weld, and the like. The original flow line 22 is split into new flow lines **22*a* and 22*b***.

To the indoor heat exchanger 15 side of the block 40 is a T-joint or elbow 42 that permits the liquid refrigerant (condensed refrigerant after the indoor condenser or heat exchanger 15) to flow from line **22*a* into line 45. Flow line 46 branches from line 45 and include a check valve 47 that permits refrigerant flow into line 52 but not the reverse. Refrigerant is prevented from exiting line 45 into line 70 by check valve 50. Liquid refrigerant passes from line 52 through T-joint 53 into line 55. Check valve 57 blocks the loss of refrigerant into line 77. Refrigerant exits flow line 55 into a liquid receiver 60. The receiver 60 acts to partially pre-cool the refrigerant by allowing the liquid refrigerant to expand slightly. Following the slight refrigerant expansion, the liquid refrigerant exits the receiver 60 into flow line 62. Due to the slight refrigerant expansion, the flow line pressure of the liquid refrigerant before the receiver 60 is higher than after the receiver 60**. The difference in pressure is usually less than about 1 psi (pounds per square inch) and usually about 0.5 psi, but other equivalent pressure values are considered acceptable.

Liquid refrigerant exits the receiver 60 via line 62 and encounters a flow line manifold 65 connecting line 62 with flow lines 67, 70 and 72. Refrigerant flow through line 72 is prevented by having solenoid flow valve 73 being closed during non-enhanced operation of the subject device. When predetermined refrigerant pressure and temperature conditioned are met (discussed fully below), the system controller or monitor 74 functions to electrically shut the solenoid flow valve 73. Additionally, since the liquid refrigerant pressure in line 46 is slightly greater than in line 70, the refrigerant flow is restricted from passing check valve 50. Therefore, the refrigerant flow is directed down line 67, through check valve 75, through T-joint 76, and into line 77. Under these operating conditions, since the pressure in line 55 is greater than the pressure in line 77, the refrigerant flow does not pass check valve 57 into line 55. The liquid refrigerant in line 77 reenters the standard heat pump plumbing at flow line **22*b* via T-joint or elbow connection 80**.

Refrigerant passes into the outdoor heat exchanger 30, continuing through line 8, entering the four-way valve 10, and exiting through flow line 35. With the subject device coupled into the heat pump, a T-joint 82 is positioned in line 35, after the flow reversal means 10 and before the compressor 5 return port. Flow line 85 exits line 35 and when the solenoid flow valve 73 is open allows refrigerant to flow into the supplemental heat exchanger 88 at a refrigerant entrance. However, when no enhanced heating is required, the closed solenoid flow valve 73 directs the refrigerant flow to the compressor 5 via accumulator 37 and line 38. Once again, it should be remembered that various heat pump configuration exist and the subject invention's exact connection points into the flow lines might need to be altered, without effecting the general scheme of enhancement action, to account for these differences.

Particular attention is drawn to FIG. 3 which discloses the subject device operating in the enhanced heating mode that generates additional expanded refrigerant to the heat pump compressor 5. As mentioned above, a control or monitor unit 74 regulates, as one of its functions, the operation of solenoid flow valve 73. The solenoid flow valve 73 is opened during the enhanced heating mode. When the solenoid flow valve 73 is opened (exact conditioned described below) the refrigerant exiting the receiver 60 travels down line 62, into the manifold 65, and out flow lines 67 and 72. It is the refrigerant that enters line 72 that will enhance the heating cycle of the heat pump.

With solenoid flow valve 73 open, the refrigerant passes and enters the supplemental heat exchanger 88 at the refrigerant entrance at a rate regulated by an expansion valve. Such expansion valves are well known in the art and includes capillary types or equivalent devices and usually the indicated TX (thermostat expansion) valve 93 with an associated temperature sensor 95. The temperature sensor 95 detects the temperature of the gaseous refrigerant exiting the supplemental heat exchanger 88 through a refrigerant exit and into flow line 85. According to standard conditions, the flow of refrigerant is adjusted to generate an acceptable temperature, and thus a maximum refrigerant expansion efficiency, at the sensor 95. By way of example only, refrigerant that enters too rapidly to produce efficient operation of the heat pump generates a cooler temperature at the sensor 95 than is desired and the standard TX valve 93 regulates the refrigerant entry to a slower rate. The supplemental coil or heat exchanger 88 is similar to the structural configuration of a standard outdoor heat exchanger and is sized to accommodate the particular building to which the heat pump is coupled.

More particularly, following the flow of the refrigerant during the enhanced operational mode of the subject device tracks the refrigerant through the open solenoid flow valve 73, past TX valve 93, and into the supplemental heat exchanger 88 where the liquid refrigerant evaporates to produce gaseous refrigerant. The refrigerant exist the supplemental heat exchanger via flow line 85, past the TX temperature sensor 95, and into the heat pump flow line 35 at T-joint 82. The inclusion of added evaporated refrigerant into the flow of refrigerant coming from the four-way valve 10, prior to the compressor, enhances the heating cycle allowing more heat to be transferred into the indoor area via the indoor heat exchanger 15 and fan 16.

Conditions for connecting (allowing refrigerant to flow through the supplemental heat exchanger 88) or disconnecting (preventing refrigerant to flow through the supplemental heat exchanger) the enhanced mode of the subject device are contained within the control or monitor unit 74. The monitor 74 detects the pressure of the gaseous refrigerant in line 85 via a T-joint 87 that couples the refrigerant into a pressure sensor 90. The pressure sensor 90 is electrically connected to the monitor 74. Also, the temperature of the refrigerant in line 35 is registered by a temperature sensor 91, also electrically connected to the monitor 74. When desired temperature and pressure conditions are satisfied to connect the supplemental heat exchanger 88, the monitor opens the solenoid flow valve 73 to enhance the heating cycle and turns on the blower or fan 92 to stimulate the passage of air over the supplemental heat exchanger 88.

For enhancement of the heating cycle employing FREON 22 TM refrigerant or similar substance, the supplemental heat exchanger 88 is connected (refrigerant flowing through solenoid flow valve 73) to the heat pump when the monitor 74 detects refrigerant temperature range from about 15° F. (about −9.4° C.) to about 55° F. (about 12.8° C.) and preferably from about 25° F. (about −3.9° C.) to about 45° F. (about 7.2° C.) at the temperature sensor 91 and a refrigerant pressure range from about 25 psi to about 75 psi and preferably from about 35 psi to about 65 psi at the pressure sensor 90. Both temperature and pressure ranges are required to be met simultaneously and if either the temperature or pressure is below or above the appropriate range the supplemental heat exchanger is disconnected or taken off-line (refrigerant flow through the solenoid flow valve 73 is halted by the monitor via closing the valve 73) until the range conditions are fulfilled, at which time the enhancement is allowed by opening the solenoid flow valve 73. Due to the presence of less usable or exchangeable heat in the surrounding outside environment, as the outside temperature gets very low any heat exchanging device will have its efficiency decrease. At some low outside temperature an alternate heating method (usually, resistance heating strips) becomes more effective in generating heat than continued use of heat exchanging devices. The selected temperature and pressure ranges reflect typical efficient heat exchanger enhancement operation ranges.

The monitor 74 contains a control system that involves standard electronics such as hard wired circuits, computer controlled software programs, computer hardware (microprocessor type controls), computer firmware, combinations of these components or approaches, or equivalent devices or methods or control. The required electronic functions of the monitor 74 are not complex. One common monitor scheme employs traditional electronic components includes a circuit that when completed activates the solenoid flow valve 73 and the fan 92. Such a circuit has a power supply, either coming from the heat pump thermostat (or equivalent device) or an independent source, a temperature sensor 91 associated switch that closes when the above cited preset temperature range is met and a pressure sensor 90 associated switch that closes when the above cited preset pressure range is fulfilled, thereby completing the circuit. Should either of the switches open (the temperature or pressure ranges not satisfied), the circuit is broken and the heating cycle enhancement terminated. As indicated above, a similar control scheme is easily implemented by computer assisted means as recorded in software, firmware, or hardware. For example, a program is written to direct a switch to be closed when both temperature and pressure ranges are satisfied and opened when either range is not reached or exceeded. Such instructions may be rendered by those skilled in the art and included in microcontroller, microprocessor, and equivalent devices and incorporated into the monitor 74. The placement of the monitor unit 74 is in any convenient location, usually physically near the supplemental heat exchanger 88 or near the thermostat that operates the heat pump by detecting the indoor temperature conditions.

The invention has now been explained with reference to specific embodiments. Other embodiments will be suggested to those of ordinary skill in the appropriate art upon review of the present specification.

Although the foregoing invention has been described in some detail by way of illustration and example for purposes of clarity of understanding, it will be obvious that certain changes and modifications may be practiced within the scope of the appended claims.

What is claimed is:

1. In association with a refrigerant recirculating heat pump having a compressor, an indoor heat exchanger, an outdoor heat exchanger, and a flow line connecting said indoor and said outdoor heat exchangers, means for enhancing the indoor heating cycle capabilities of said heat pump, comprising:

a) means for generating additional expanded refrigerant and transferring said additional expanded refrigerant to said compressor and b) means for monitoring said refrigerant's pressure and temperature at a location just prior to said refrigerant entering said compressor, wherein said monitoring means automatically connects said means for generating additional expanded refrigerant to said heat pump when selected refrigerant temperature and pressure ranges are satisfied, to enhance said heating cycle capabilities, and automatically disconnects said means for generating additional expanded refrigerant to said heat pump when said selected refrigerant temperature and pressure ranges are not satisfied.

2. Means for enhancing the indoor heating cycle capabilities of a heat pump according to claim 1, wherein said means for generating and transferring additional expanded refrigerant to said compressor comprises:

a) a supplemental heat exchanger having a refrigerant entrance for said refrigerant, wherein when said heating cycle is being enhanced said refrigerant enters said supplemental heat exchanger in a liquid state, and a refrigerant exit for said refrigerant, wherein when said heating cycle is being enhanced said refrigerant exits said supplemental heat exchanger in a gaseous state;

b) a flow line block in said flow line connecting said indoor heat exchanger and said outdoor heat exchanger that inhibits the direct passage of refrigerant between said indoor and said outdoor heat exchangers;

c) a first refrigerant flow line connected between said indoor heat exchanger and said block that directs said refrigerant into said supplemental heat exchanger when said selected refrigerant temperature and pressure ranges are satisfied;

d) a second refrigerant flow line connected between said outdoor heat exchanger and said block that directs said refrigerant only into said outdoor heat exchanger when said selected refrigerant temperature and pressure ranges are not satisfied; and e) a third refrigerant flow line that connects said supplemental heat exchanger by said refrigerant exit to said heat pump prior to said compressor and directs said refrigerant into said compressor when said selected refrigerant temperature and pressure ranges are satisfied.

3. Means for enhancing the indoor heating cycle capabilities of a heat pump according to claim 2, further comprising a liquid receiver located within said first refrigerant flow line that connects said supplemental heat exchanger by said refrigerant entrance to said heat pump between said indoor heat exchanger and said flow line block.

4. Means for enhancing the indoor heating cycle capabilities of a heat pump according to claim 1, wherein said monitoring means comprises:

a) a temperature sensor for sensing the temperature of said refrigerant prior to said refrigerant entering said compressor;

b) a pressure sensor for sensing the pressure of said refrigerant prior to said refrigerant entering said compressor;

c) means for interrupting said refrigerant's flow into said supplemental heat exchanger refrigerant entrance;

d) a fan for blowing surrounding air over said supplemental heat exchanger; and e) a monitor having means for detecting both the temperature sensed by said temperature sensor and said pressure sensed by said pressure sensor and activating both said fan and said refrigerant interrupting means to allow said refrigerant to enter said supplemental heat exchanger when said selected refrigerant temperature and pressure ranges are satisfied.

5. Means for enhancing the indoor heating cycle capabilities of a heat pump according to claim 4, wherein said refrigerant flow interrupting means comprises a solenoid flow valve.

6. In association with a refrigerant recirculating heat pump having a compressor with a high pressure refrigerant exit and a low pressure refrigerant entrance, a refrigerant flow reversal means connected to said high pressure refrigerant exit by a flow line and receiving high pressure refrigerant from said compressor, an indoor heat exchanger having first and second ends wherein said indoor heat exchanger is connected by said first indoor heat exchanger end via a flow line to said refrigerant flow reversal means, an outdoor heat exchanger having first and second ends wherein said outdoor heat exchanger is connected by said first outdoor heat exchanger end via a flow line to said second indoor heat exchanger end and by said second outdoor heat exchanger end via a flow line to said refrigerant flow reveral means, and a flow line between said refrigerant flow reversal means and said compressor low pressure refrigerant entrance for returning low pressure refrigerant to said compressor, means for enhancing the indoor heating cycle capabilities of said heat pump, comprising:

a) means for generating additional expanded refrigerant and transferring said additional expanded refrigerant to said compressor and b) means, associated with said refrigerant flow lines, for monitoring refrigerant pressure and temperature after said refrigerant flow reversal means and prior to said refrigerant entering said compressor, wherein said monitoring means connects and disconnects said generating and transferring of said additional expanded refrigerant to said compressor.

7. Means for enhancing the indoor heating cycle capabilities of a heat pump according to claim 6, wherein said monitoring means automatically connects said generating and transferring of said additional expanded refrigerant to said compressor when said monitoring means detects a refrigerant temperature range between about 15° F. and about 55° F. and a pressure range between about 25 psi and about 75 psi and disconnects said generating and transferring of said additional expanded refrigerant to said compressor above and below either said about 15° F. to about 55° F. range or said about 25 psi to about 75 psi ranges.

8. Means for enhancing the indoor heating cycle capabilities of a heat pump according to claim 6, wherein said monitoring means automatically connects said generating and transferring of said additional expanded refrigerant to said compressor when said monitoring means detects a refrigerant temperature range between about 25° F. and about 45° F. and a pressure range between about 35 psi and about 65 psi and disconnects said generating and transferring of said additional expanded refrigerant to said compressor above and below either said about 25° F. to about 45° F. range or said about 35 psi to about 65 psi ranges.

9. Means for enhancing the indoor heating cycle capabilities of a heat pump according to claim 6, wherein said means for generating and transferring additional expanded refrigerant to said compressor comprises:

a) a supplemental heat exchanger having a refrigerant entrance for said refrigerant, wherein when said heating cycle is being enhanced said refrigerant enters said supplemental heat exchanger in a liquid state, and a refrigerant exit for said refrigerant, wherein when said heating cycle is being enhanced said refrigerant exits said supplemental heat exchanger in a gaseous state;

b) a flow line block in said flow line connecting said second indoor heat exchanger end and said first outdoor heat exchanger end that inhibits the direct passage of refrigerant between said indoor and said outdoor heat exchangers;

c) a first refrigerant flow line connecting said supplemental heat exchanger by said refrigerant entrance to said heat pump between said second indoor heat exchanger end and said flow line block that directs said refrigerant into said supplemental heat exchanger when said selected refrigerant temperature and pressure ranges are satisfied;

d) a second refrigerant flow line connected between said outdoor heat exchanger and said block that directs said refrigerant only into said outdoor heat exchanger when said selected refrigerant temperature and pressure ranges are not satisfied; and e) a third refrigerant flow line that connects said supplemental heat exchanger by said refrigerant exit to said heat pump prior to said compressor between said refrigerant flow reversal means and said compressor and directs said refrigerant into said compressor when said selected refrigerant temperature and pressure ranges are satisfied.

10. Means for enhancing the indoor heating cycle capabilities of a heat pump according to claim 6, wherein said monitoring means comprises:

a) a temperature sensor for sensing the temperature of said refrigerant between said refrigerant flow reversal means and said compressor;

b) a pressure sensor for sensing the pressure of said refrigerant prior to said refrigerant entering said compressor;

c) a solenoid flow valve for interrupting said refrigerant's flow into said supplemental heat exchanger refrigerant entrance;

d) a fan for blowing surrounding air over said supplemental heat exchanger; and e) a monitor having means for detecting both the temperature sensed by said temperature sensor and said pressure sensed by said pressure sensor and activating both said fan and said solenoid flow valve to allow said refrigerant to enter said supplemental heat exchanger when said selected refrigerant temperature and pressure ranges are satisfied.

11. In association with a refrigerant recirculating heat pump having a compressor with a high pressure refrigerant exit and a low pressure refrigerant entrance, a refrigerant flow reversal means connected to said high pressure refrigerant exit by a flow line and receiving high pressure refrigerant from and second ends wherein said indoor heat exchanger is connected by said first indoor heat exchanger end via a flow line to said refrigerant flow reversal means, an outdoor heat exchanger having first and second ends wherein said outdoor heat exchanger is connected by said first outdoor heat exchanger end via a flow line to said second indoor heat exchanger end and by said second outdoor heat exchanger end via a flow line to said refrigerant flow reversal means, and a flow line between said refrigerant flow reversal means and said compressor low pressure refrigerant entrance for returning low pressure refrigerant to said compressor, a method of enhancing the indoor heating cycle capabilities of a heat pump, comprising:

a) determining that said refrigerant's temperature, within said flow line between said flow reversal means and said compressor low pressure entrance, and said refrigerant's pressure, prior to said compressor low pressure entrance, are both within selected temperature and pressure ranges, respectively; and b) passing said refrigerant, during said heating cycle, from said second indoor heat exchanger end to a supplemental heat exchanger to enhance said heating cycle capabilities when said temperature and pressure are both within said selected temperature and pressure ranges, respectively.

12. A method according to claim 11, wherein said temperature determination is by means of a temperature sensor and said pressure determination is by means of a pressure sensor, wherein a monitor receives said determinations for both said sensors and said monitor upon detecting both said temperature and pressure ranges existing simultaneously activates a solenoid flow valve thereby admitting said refrigerant into said supplemental heat exchanger.

13. A method according to claim 12, wherein said selected refrigerant temperature range is between about 15° F. and about 55° F. and said selected refrigerant pressure range is between about 25 psi and about 75 psi.

14. A method according to claim 12, wherein said selected refrigerant temperature range is between about 25° F. and about 45° F. and said selected pressure range is between about 35 psi and about 65 psi, wherein said solenoid flow valve disconnects said supplemental heat exchanger from said heat pump above and below either said about 25° F. to about 45° F. range or said about 35 psi to about 65 psi ranges.

* * * * *